United States Patent [19]

Yamagami

[11] 4,145,920

[45] Mar. 27, 1979

[54] APPARATUS FOR DETECTING ABNORMAL CONDITION OF WIRE ROPE

[75] Inventor: Takatoshi Yamagami, Inazawa, Japan

[73] Assignee: Mitsubishi Denki Kabushiki Kaisha, Tokyo, Japan

[21] Appl. No.: 810,629

[22] Filed: Jun. 27, 1977

[30] Foreign Application Priority Data

Jul. 21, 1976 [JP] Japan ..... 51-87079

[51] Int. Cl.[2] ..... B65H 43/04

[52] U.S. Cl. ..... 73/158; 73/160; 187/1 R; 187/20

[58] Field of Search ..... 73/158, 160; 187/20, 187/1 R; 254/173 R

[56] References Cited

U.S. PATENT DOCUMENTS

| | | | |
|---|---|---|---|
| 2,308,211 | 1/1943 | Sanford | 187/1 R |
| 2,367,958 | 1/1945 | Michaelson | 73/160 |
| 2,636,951 | 4/1953 | Fahringer | 73/160 X |
| 2,735,945 | 2/1956 | Colton et al. | 73/158 X |
| 3,208,729 | 9/1965 | Townsen | 254/173 R |
| 3,386,145 | 6/1968 | Harris | 73/160 |
| 3,405,556 | 10/1968 | Gonsalves et al. | 73/160 |
| 3,902,364 | 9/1975 | Craig et al. | 73/160 |

*Primary Examiner*—Charles Gorenstein

*Attorney, Agent, or Firm*—Oblon, Fisher, Spivak, McClelland & Maier

[57] ABSTRACT

An apparatus for detecting an abnormal condition of a wire rope comprises a detecting element, a part of which is disposed adjacent to an outer surface of the wire rope for longitudinally moving and the other part of which is held on a supporter and which detects the abnormal condition of the wire rope.

5 Claims, 6 Drawing Figures

APPARATUS FOR DETECTING ABNORMAL CONDITION OF WIRE ROPE

BACKGROUND OF THE INVENTION

1. Field of the Invention

The present invention relates to an apparatus for detecting an abnormal condition of a main rope for an elevator.

2. Description of the Prior Art

Recently, developments which respect to high speed and high rise elevators have been remarkable. The wire ropes such as a main rope of such elevators have been used under remarkably severe conditions in comparison with the conventional elevator from the viewpoints of twist, slip and wearing. Accordingly, element wires of the wire rope have been easily cut. The damage of the wire rope causes not only the trouble of the wire rope but also causes serious troubles that the element wires and the strand projected from the wire rope touch instruments in a hatchway so as to induce a serious accident with respect to the instrument or an accident involving completely cutting the wire rope. The safety of elevators has been remarkably damaged by such developments.

However, the problem of cutting of the element wires and the strand has not easily occur when the travel height is high and the wire rope is long. Even so, sometimes, the cutting problem has not found and has been suddenly occurred during the driving of the elevator.

When the elevator is driven with a cut of the strand, the strand is gradually loosed to cause the damage of the instruments in the hatchway by the cut strand.

SUMMARY OF THE INVENTION

It is an object of the present invention to provide an apparatus for detecting abnormal conditions of a wire rope which has a simple structure and finds the cut of element wires and strands at an early stage so as to overcome the above-mentioned disadvantages.

The foregoing and other objects of the present invention have been attained by providing a detecting element, a part of which is disposed adjacent to an outer surface of a wire rope for longitudinally moving and the other part of which is held on a fixed part and which detects the abnormal condition of the wire rope.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
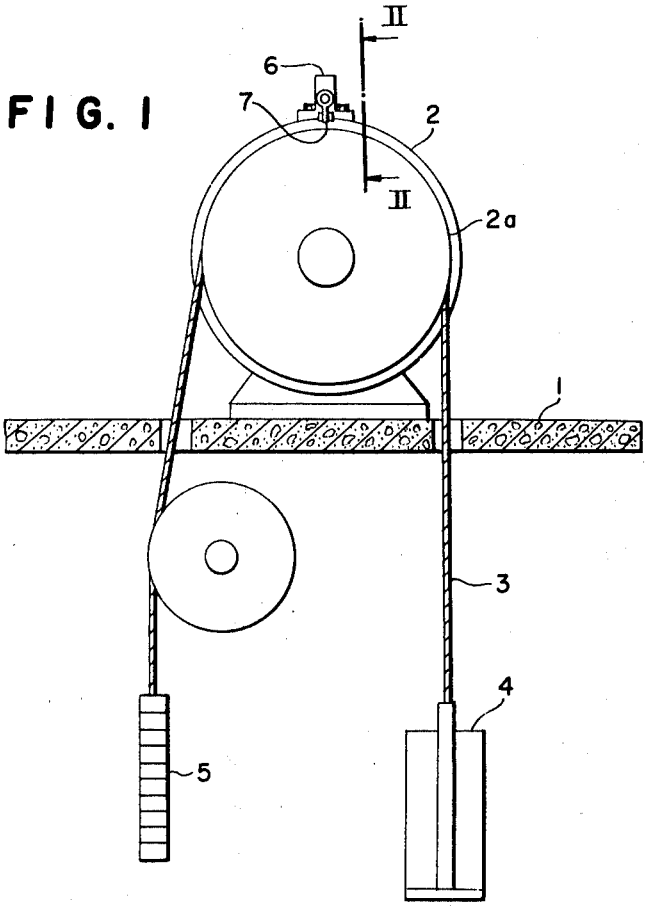
FIG. 1 is a schematic view of one embodiment of an elevator apparatus having an apparatus for an detecting abnormal condition of a wire rope according to the present invention.
Figure 2:
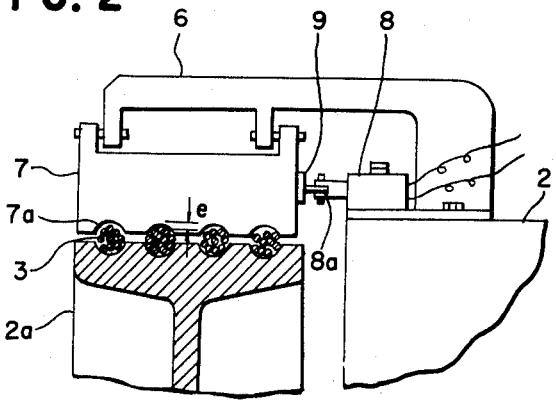
FIG. 2 is a sectional view taken along the line II-II of FIG. 1.
Figure 3:
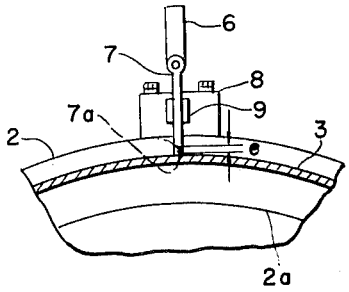
FIG. 3 is a left side view of the apparatus of FIG. 2.

Referring to FIGS. 1 to 4, a first embodiment of the present invention will be illustrated.

In drawings, the reference numeral (1) designates a floor for a machine room of elevator; (2) designates a driving machine; (2*a*) designates a driving sheave; (3) designates a wire rope as plural main ropes which are wound on the driving sheave (2*a*). A cage (4) and a counterweight (5) are respectively connected to the ends of the wire rope under hanging them. The reference numeral (6) designates a supporter, a part of which is fixed on the fixed part of the driving machine (2) and the other part of which is disposed to face the cylindrical surface of the driving sheave (2*a*) with a gap; and (7) designates a detector, a part of which is pivotally held by the supporter (6) so as to be pivotable about an axis parallel to the axis of rotation of the driving sheave (2*a*) and the other of which is faced to the main rope (3) wound on the driving sheave (2*a*). Concave portions (7*a*) are respectively formed to face the main ropes (3) with each gap e. The reference numeral (8) designates a detecting element of a switch which is fitted on the supporter (6) and the operating part (8*a*) of the detecting element (8) is disposed to the detector (7); and (9) designates a contact plate which is fixed on the faced edges of the detector (7) and the detecting element (8). The operating part (8*a*) of the detecting element (8) is contacted with the contact plate (9) under the conditions of FIGS. 2 and 3.

Figure 4:
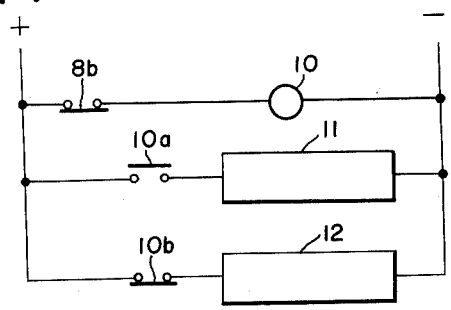
FIG. 4 is a circuit diagram of the important part of the embodiment of FIGS. 1 to 3.

In FIG. 4, the reference numeral (8*b*) designates a normal closed contact for the detecting element (8); (10) designates a relay for detecting abnormal condition; (10*a*) designates a normally opened contact; (10*b*) designates a normally closed contact; (11) designates an alarm device for informing an abnormal condition; and (12) designates a control device for the elevator.

When the driving machine is driven, the cage (4) and the counterweight (5) respectively travel to opposite direction each other through the main rope (3). When the abnormal condition of the main rope (3) is not found, the main rope (3) passes through the gap e without contacting with the detector (7). The detecting element (8) is pressed to the contact plate (9) whereby the contact (8*b*) is opened and the relay for detecting abnormal condition (10) is turned off and the alarm device (11) is not actuated. The control device (12) is actuated by the circuit of positive pole (+) to contact (10*b*) to control device (12) to negative pole (−), whereby the elevator is operated in the normal condition.

When a projected wire of the broken strand or an abnormal condition of the peripheral part such as the increase of diameter of the main rope (3) is caused or the abnormal condition of the main rope (3) being derailed from the guide groove of the driving sheave (2*a*) is caused, the detector (7) is turned by contacting with the abnormal part of the main rope (3) which is passed through the part corresponding to the detector (7), whereby the detecting element (8) is disconnected from the contact plate (9) to project the operating part (8*a*). The contact (8*b*) is closed to turn on the relay for detecting abnormal condition (10) by the circuit of positive pole (+) to contact (8*a*) to relay (10) to negative pole (−). The alarm device (11) is actuated by the circuit of positive pole (+) to contact (10*a*) to alarm device (11) to negative pole (−), and the contact (10*b*) is opened to extinguish the control device (12) whereby the elevator is stopped. As described above, when the abnormal condition is caused at the outer surface of the main rope (3), the abnormal condition can be easily and automatically detected whereby damage of to the elevator apparatus caused by breaking of the main rope (3) under the abnormal condition and the corresponding uneasiness of the passengers can be prevented before such trouble occurs. The detection can be attained with high reliability without inspections.

It is clear that the same effect can be attained by fixing the detector (7) and the detecting element (8) on a fixed part around a deflector sheave of the elevator or a suspension sheave of the cage (4) or a floor (1).

The same effect can be attained by using a photodetector to which rays pass across the peripheral part of the main rope (3) as the detector (7) and the detecting element (8).

Figure 5:
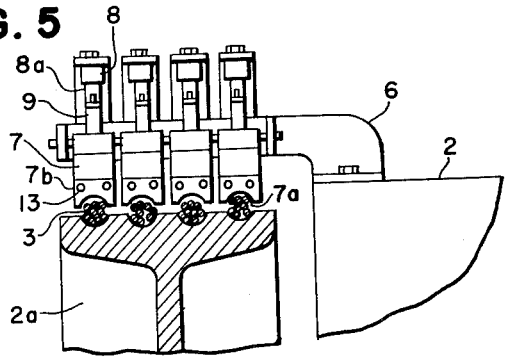
FIG. 5 is a sectional view of the other embodiment of the apparatus for detecting the abnormal condition of the wire rope according to the present invention.
Figure 6:
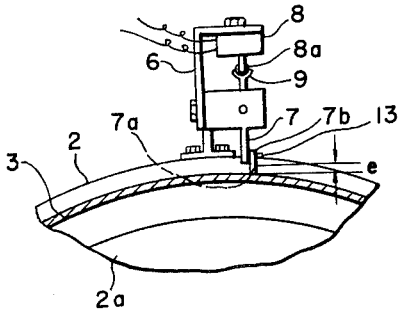
FIG. 6 is a left side view of the apparatus of FIG. 5.

FIGS. 5 and 6 show the other embodiment of the apparatus of the present invention. In FIGS. 5 and 6, like reference numerals designate identical or corresponding parts of FIGS. 1 to 4.

The reference numeral (7) designates detectors which are respectively disposed to face each of the main ropes (3); (7*b*) designates contact pieces made of a resilient material such as synthetic resin which each respectively have each concave portions (7*a*) and long groove in vertical direction of FIG. 5. The contact piece (7*b*) is connected to the rotary end of the detector (7) through the groove by a small screw (13). The reference numeral (8) designates a detecting element of a switch disposed to each of the detectors (7).

In the embodiment of FIGS. 5 and 6, each pair of the detectors (7) and the detecting elements (8) are disposed around each of the main ropes (3) in the embodiment of FIGS. 1 to 4. The detailed description of the embodiment is omitted. However, it is clear that the same effect of the embodiment of FIGS. 1 to 4 can be attained in the embodiment of FIGS. 5 and 6.

In this embodiment, the contact piece (7*b*) which is detachable and whose gap from the main rope (3) is adjustable, is used, the gap between the main rope (3) and the contact piece (7*b*) can be adjusted and the buffering action is attained to prevent the trouble such as a deformation of the detector (7) by shock of the abnormal part applied to the detector (7) when the abnormal part of the main rope (3) is passed thereby.

Even though the concave portion (7*a*) of the contact piece (7*b*) is damaged, only the damaged contact piece need be exchanged. The detector (7) can be easily maintained in such manner. Even though a pair of the detector (7) and the detecting element (8) are damaged, the function of detecting the abnormal condition of the main rope (3) is partially maintained.

As described above, in accordance with the present invention, one or more detectors are disposed adjacent to an outer surface of the wire rope for longitudinally moving and are held on a fixed part near the passage of the wire rope and the increase of the diameter of the wire rope and an abnormal condition of the outer surface such as the cut of the strand can be detected by the detectors whereby the abnormal condition of the wire rope can be detected with high reliability without inspections and the trouble caused by the abnormal condition of the wire rope can be prevented before such trouble occurs. Obviously, many modifications and variations of the present invention as possible in light of the above teachings. It is therefore to be understood that within the scope of the appended claims, the present invention may be practiced otherwise than as specifically described herein.

What is claimed as new and intended to be secured by United States Letters Patent is:

1. An apparatus for detecting an abnormal condition of the peripheral part of a wire rope which comprises:
   - a supporter;
   - a driving sheave upon which said wire rope is wound;
   - a detecting element connected to said supporter, a part of which is disposed adjacent to an outer surface of said wire rope for pivotal movement about an axis parallel to the axis of rotation of said driving sheave and the other part of which is held on said supporter and which detects the abnormal condition of the wire rope;
   - means for pivotally connecting said detecting element to said supporter; and
   - a concave portion formed on said detecting element at the part thereof facing the outer surface of said wire rope and positioned around said wire rope wherein, when no abnormal condition of the peripheral part of the wire rope exists, the wire rope passes through the concave portion and upon engagement of said abnormal condition of the peripheral part of said wire rope said detecting element is pivoted about said axis parallel to the axis of rotation of said driving sheave.

2. An apparatus for detecting an abnormal condition of a projected or protruded part of broken strands of a wire rope for an elevator apparatus having a plurality of main ropes holding a cage and a counterweight at ends thereof which are wound on a cylindrical surface of a driving sheave of a traction machine, which comprises:
   - a supporter, one end of which is fixed on a fixed part of said traction machine and the other end of which is faced to the cylindrical surface of said driving sheave; and
   - a detecting element, one end of which is pivotally connected to said supporter so as to pivot about an axis parallel to the axis of rotation of said driving sheave and the other end of which is faced to said main ropes wound on said driving sheave such that said detecting element is turned by contacting with a projected or protruded part of said strands of any of said wire ropes when such a projected or protruded part is disposed at the outer surface of said wire rope as the abnormal condition and a plurality of concave portions formed on said detecting element to face the concave portions to the outer surfaces of said main ropes such that said main ropes are positioned in said concave portions and wherein, when no abnormal condition in said main ropes exists, the main ropes pass through said plurality of concave portions formed on said detecting element and upon engagement of said projected or protruded part of broken strands of said wire rope, said detecting element is pivoted about said axis parallel to the axis of rotation of said driving sheave.

3. An apparatus for detecting an abnormal condition of a projected or protruded part of broken strands of a wire rope for an elevator apparatus having a plurality of main ropes holding a cage and a counterweight at ends thereof which are wound on a cylindrical surface of a driving sheave of a traction machine, which comprises:
   - a supporter, one end of which is fixed on a fixed part of said traction machine and the other end of which is faced to the cylindrical surface of said driving sheave; and a plurality of detecting elements, each having one end which is pivotally connected to said supporter so as to pivot about an axis parallel to the axis of rotation of said driving sheave and the other end of which is faced to one of said main ropes wound on said driving sheave such that said detecting element is turned by contacting with a projected or protruded part of said strands of said wire rope when such a projected or protruded part is disposed at the outer surface of said wire rope as the abnormal condition, said plurality of detecting elements each including concave portions which are respectively faced to the outer surfaces of said main ropes such that said main ropes are positioned in said concave portions and wherein, when no abnormal condition in said plurality of main ropes exists, said main ropes pass through said concave portions of said plurality of detecting elements and upon engagement of said projected or protruded part of broken strands of said wire rope said detecting element is pivoted about said axis parallel to the axis of rotation of said driving sheave.

4. An apparatus for detecting an abnormal condition of a peripheral part of a wire rope for an elevator apparatus having a plurality of main ropes holding a cage and a counterweight at ends thereof which are wound on a cylindrical surface of a driving sheave of a traction machine; which comprises:

a supporter, one end of which is fixed on a fixed part of said traction machine and the other end of which is faced to the cylindrical surface of said driving sheave;

a detecting element, one end of which is pivotally connected to said supporter so as to pivot about an axis parallel to the axis of rotation of said driving sheave and the other end of which is faced to said main ropes wound on said driving sheave;

a switch held on a fixed part of said traction machine or said supporter, an operating part of which contacts said detecting element; and a contact plate which is held on an end of said detecting element to face to said switch and which contacts the operating part of said switch such that when said detecting element is turned by contacting with a projected or protruded part of strands of said wire rope as the abnormal condition, said operating part detaches from said contact plate, and a plurality of concave portions are formed on said detecting element and face said main ropes such that said main ropes are positioned in said concave portions formed on said detecting element and wherein, when no abnormal condition in said main ropes exists, said main ropes pass through said plurality of concave portions formed on said detecting element and upon engagement of said abnormal condition of said wire rope, said detecting element is pivoted about said axis parallel to the axis of rotation of said driving sheave.

5. An apparatus for detecting abnormal conditions of a peripheral part of a wire rope for an elevator apparatus having a plurality of main ropes holding a cage and a counterweight at ends thereof which are wound on a cylindrical surface of a driving sheave of a traction machine, which comprises:

a supporter, one end of which is fixed on a fixed part of said traction machine and the other end of which is faced to the cylindrical surface of said driving sheave;

a plurality of detecting elements, each having one end which is pivotally connected to said supporter so as to pivot about an axis parallel to the axis of rotation of said driving sheave and the other end of which is faced to one of said main ropes wound on said driving sheave;

a plurality of switches held on a fixed part of said traction machine or said supporter, an operating part of each contacting one of said detecting elements; and a contact plate which is held on an end of each of said detecting elements to face each of said respective switches and which contacts to the operating part of each of said respective switch such that when said detecting element is turned by contacting with a projected or protruded part of strands of said wire rope at the outer surface of said wire rope as the abnormal condition, said operating part detaches from said contact plate, said detecting elements each including concave portions which are respectively faced to the outer surfaces of said main ropes such that said main ropes such that said main ropes are positioned in said concave portions of said plurality of detecting elements and wherein, when no abnormality in said main ropes exists, said main ropes pass through said concave portions of said plurality of detecting elements and upon engagement of said abnormal condition of said wire rope, said detecting element is pivoted about said axis parallel to the axis of rotation of said driving sheave.

* * * * *